US007591028B2

(12) United States Patent
Roma et al.

(10) Patent No.: US 7,591,028 B2
(45) Date of Patent: Sep. 22, 2009

(54) AUTOMATIC FUTON FRAME

(75) Inventors: John K. Roma, Orchard Park, NY (US); Paul J. Morgante, Jr., Kenmore, NY (US)

(73) Assignee: Otis Bed Manufacturing Company, Inc., Buffalo, NY (US)

( * ) Notice: Subject to any disclaimer, the term of this patent is extended or adjusted under 35 U.S.C. 154(b) by 0 days.

(21) Appl. No.: 12/016,233

(22) Filed: Jan. 18, 2008

(65) Prior Publication Data

US 2009/0183308 A1 Jul. 23, 2009

(51) Int. Cl.
*A47C 17/17* (2006.01)
*A47C 17/04* (2006.01)

(52) U.S. Cl. ..... 5/37.1; 5/41; 5/47; 5/927

(58) Field of Classification Search ..... 5/41, 5/37.1, 47, 927.915, 2.1, 12.1, 510; 297/65, 297/318, 342, 354.13
See application file for complete search history.

(56) References Cited

U.S. PATENT DOCUMENTS

| | | | |
|---|---|---|---|
| 3,458,877 | A | 8/1969 | Edwards |
| 4,563,784 | A | 1/1986 | Shrock et al. |
| 4,937,900 | A | 7/1990 | Bridges |
| 5,129,114 | A | 7/1992 | Withers |
| 5,790,993 | A | 8/1998 | Roma et al. |
| 6,061,848 | A | 5/2000 | Roma et al. |
| 6,138,299 | A | 10/2000 | Roma et al. |
| 2003/0172455 | A1 | 9/2003 | Roma et al. |

*Primary Examiner*—Peter M Cuomo
*Assistant Examiner*—Brittany M Wilson
(74) *Attorney, Agent, or Firm*—Hodgson Russ LLP

(57) ABSTRACT

An automatically adjustable futon frame includes a back and a seat pivotally joined to one another for folding about a transverse axis extending between opposite sides of the frame. A single motor is mounted on the seat and includes a transversely extending drive shaft on which a pair of pinions are mounted. The pinions are arranged to mate with a pair of toothed racks fixed to the opposite sides of the frame. The drive shaft may be arranged to extend through opposite side members of the seat, and ends of the drive shaft may be received in channels in the sides of the frame. A pair of link arms are provided on each side of the frame to pivotally connect the back to the sides of the frame. The motor is operable to adjust the frame between a sofa position and a bed position.

11 Claims, 4 Drawing Sheets

AUTOMATIC FUTON FRAME

FIELD OF THE INVENTION

The present invention relates generally to sofa-bed frames for adjustably supporting a futon mattress, and more particularly to a futon mattress frame having seat and back portions automatically adjustable between a sofa position and a bed position.

BACKGROUND OF THE INVENTION

Manually operated futon frames having a seat and a back linked to the seat for guided relative motion to permit adjustment between a sofa position and a bed position are well known in the art. In a common futon frame arrangement, the seat and back are pivotally connected to each other, and the back is connected to each adjacent side of the frame by respective link arms having one end pivotally connected to the back and another end pivotally connected to the associated side of the frame. In another common arrangement, pairs of follower bearings extend from the back for travel within corresponding pairs of guide channels provided in each side of the frame. With either type of arrangement, manual adjustment from a sofa position to a bed position is made by sliding the seat forward such that back is caused to follow and assume a horizontal position level with the seat. Manual adjustment from a bed position to a sofa position is carried out by pushing the seat backward at a slight downward angle to force the back into a generally vertical position. U.S. Pat. No. 5,129,114 illustrates this type of construction.

Heretofore, various attempts have been made to automate the adjustment operation of futon frames by providing a single stationary drive motor as means for indirectly driving a follower bracket connected to impart adjustment motion to the seat and back. Examples may be seen in U.S. Pat. Nos. 3,458,877; 4,563,784; and 4,937,900.

A primary challenge encountered in the design of an automatically adjustable futon frame is that a relatively large force is required to initiate backward movement of the seat to dislodge the back from its horizontal position. Prior art automatic frames have typically relied on complex multiple-bar linkages and/or brute power in the electric motor to meet this challenge. Drawbacks of a complex linkage system include added manufacturing cost, increased frame weight, and decreased reliability. Drawbacks of using a single high-powered motor include complexities in the drive train necessary to evenly transmit force to each side of the frame for smooth adjustment motion, with corresponding increase in manufacturing cost. Consequently, despite the long-recognized desirability of an automatically adjustable futon frame, as evidenced by the patents mentioned above, such item is not widely available to consumers at a reasonable price.

U.S. Pat. Nos. 5,790,993; 6,061,848; and 6,138,299, owned by the assignee of the present application and invention, disclose various configurations aimed at providing a commercially acceptable automatic futon frame. These configurations are based on a dual-motor design having a pair of motors mounted one on each opposite side of the seat to drive a respective pinion mated with an inclined rack fixed to the associated side of the frame. While these designs represented and advancement toward the goal of a commercially viable automatic futon frame, the dual-motor design proved costly, and synchronization and balance of drive forces were difficult to achieve in practice.

SUMMARY OF THE INVENTION

Therefore, it is an object of the present invention to provide an automatically adjustable futon frame which is relatively inexpensive to manufacture, operates smoothly and quietly during position adjustment, and is reliable.

In furtherance of this object, an automatically adjustable futon frame is provided that generally comprises first and second opposing sides connected by front and rear support members extending laterally between the first and second sides. A back is situated between the first and second sides, and the back has first and second side members respectively adjacent to the first and second frame sides. A seat is pivotally connected to the back for folding along a laterally extending axis, and the seat has first and second side members. First and second racks are respectively fixed to the first and second sides of the frame, and a motor is fixed to the seat. The motor includes a drive shaft rotatable about a laterally extending drive axis, and first and second pinions are mounted on the drive shaft for rotation with the drive shaft, wherein the first pinion engages the first rack and the second pinion engages the second rack. A first link arm is pivotally coupled to the first side member of the back and to the first side of the frame, and a second link arm is pivotally coupled to the second side member of the back and to the second side of the frame. Consequently, the motor is operable to automatically adjust the back and the seat between a sofa position and a bed position.

In an embodiment of the invention, the motor is fixed to the first side member of the seat, the drive shaft extends through respective passages in first and second side members, and the opposite ends of the drive shaft are received in respective channels in the first and second sides of the frame. A pair of limit switches may be provided on the first side of the frame adjacent opposite ends of the rack for engagement by the drive shaft to shut off the motor upon reaching the sofa position and the bed position.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
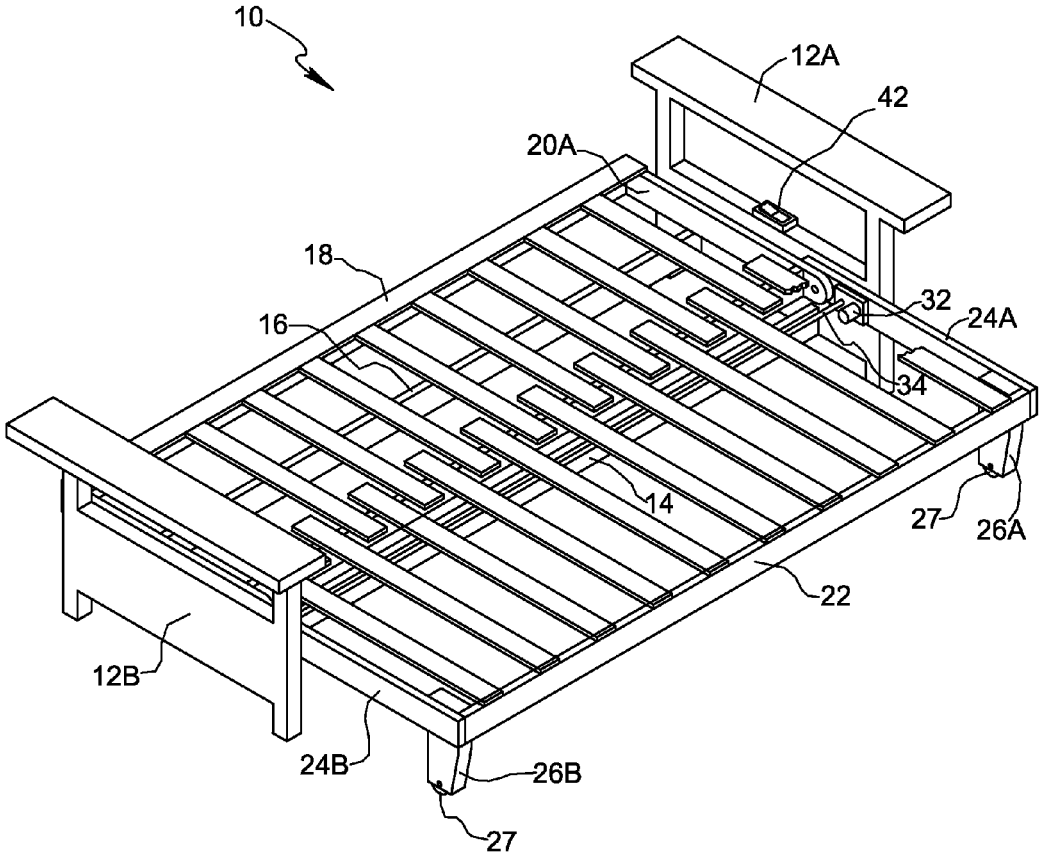
FIG. 1 is an isometric view of an automatic futon frame formed in accordance with an embodiment of the present invention, in its bed position.
Figure 2:
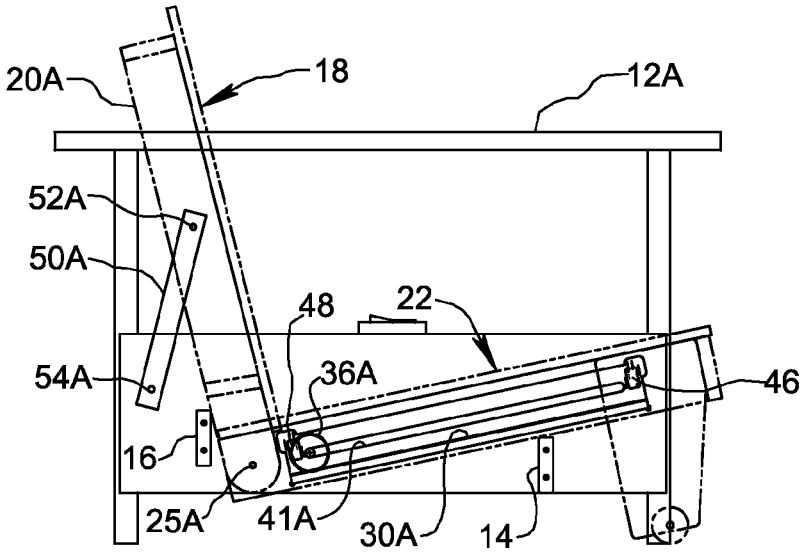
FIG. 2 is an elevational view showing a first side of the futon frame as viewed from a second opposite side of the futon frame, wherein a back and a seat of the frame are shown in phantom line in their sofa position.
Figure 6:
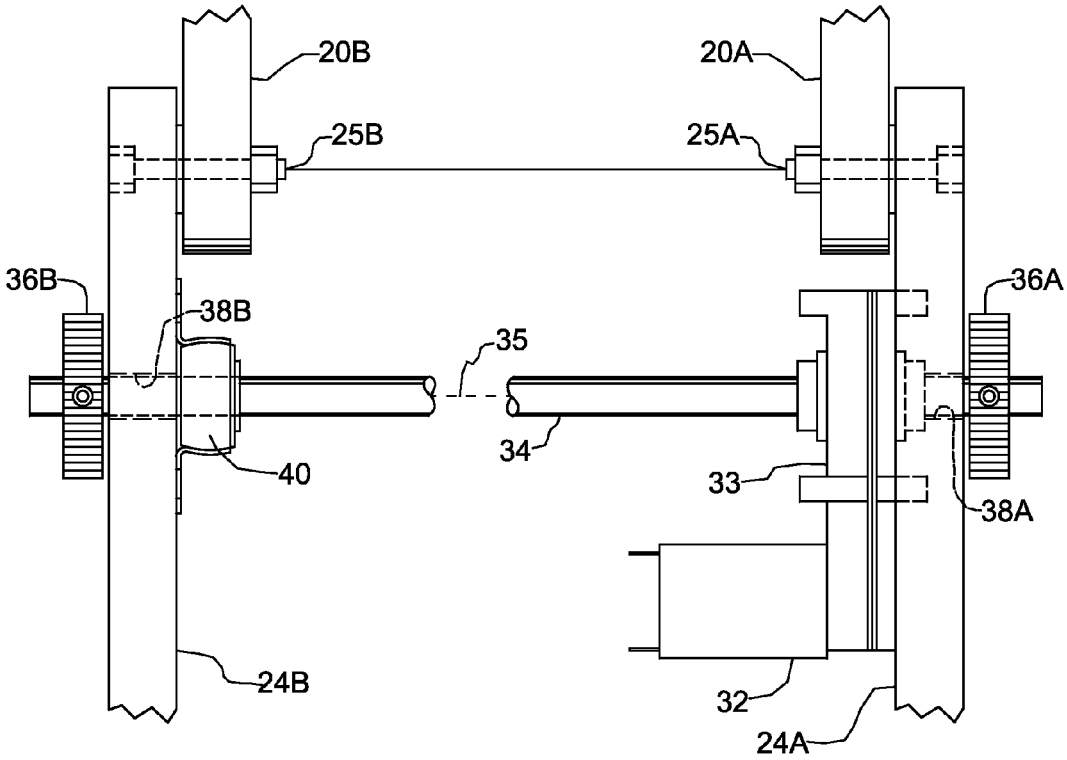
FIG. 6 is a top plan view showing a motor drive system of the futon frame.

FIG. 1 shows a futon frame 10 formed in accordance with an embodiment of the present invention. Futon frame 10 comprises a pair of opposite sides 12A, 12B connected by a front support member 14 and a rear support member 16 extending laterally between sides 12A, 12B. Frame 10 further comprises a back 18 situated between sides 12A, 12B and including first and second side members 20A, 20B (see also FIG. 6) near respective sides 12A, 12B, and a seat 22 situated between sides 12A, 12B and having first and second side members 24A, 24B near respective sides 12A, 12B. As best seen in FIG. 6, seat 22 is pivotally connected to back 18 for folding along a laterally extending axis by pivot pins 25A, 25B joining first side members 24A and 20A and second side members 24B and 20B of the seat and back. A first link arm 50A is pivotally coupled to first side member 20A of back 18 and to first side 12A by pivots 52A and 54A, respectively. Likewise, a second link arm 50B is pivotally coupled to second side member 20B of back 18 and to second side 12B by pivots 52B and 54B, respectively. Link arms 50A, 50B may be straight, rigid members. Seat 22 includes a pair of support legs 26A and 26B generally near a front portion of the seat. The legs may include wheels 27 (the term "wheels" including casters, rollers, and the like) at their bottom ends for engaging a floor on which frame 10 is situated in a manner which minimizes friction.

As may be seen in FIGS. 2 through 5, a first toothed rack 30A is fixed to first opposing side 12A and a second toothed rack 30B is fixed to second opposing side 12B. Racks 30A and 30B slope downwardly as they extend front to rear on respective sides 12A, 12B.

Figure 7:
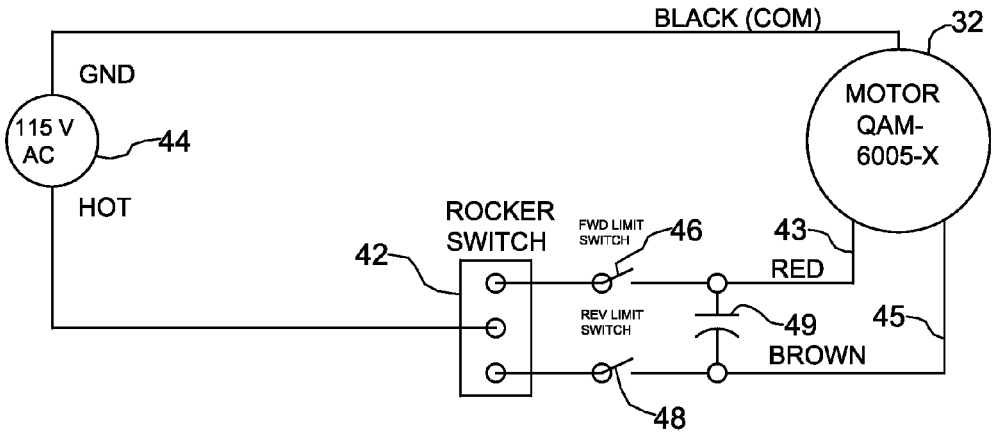
FIG. 7 is a schematic block diagram showing electrical circuitry of the motor drive system.

Referring also now to FIG. 6, a motor 32 is fixed to seat 22 and includes a gearbox 33 and a drive shaft 34. In the embodiment depicted, motor 32 is fixed to first side member 24A of seat 22, however motor 32 may be mounted to the seat at other locations. Motor 32 is operable to rotate drive shaft 34 about a laterally extending drive axis 35. First and second pinions 36A, 36B are mounted on drive shaft 34 near opposite ends of the drive shaft for rotation therewith. The first pinion 36A is arranged to mate with first rack 30A, while second pinion 36B is arranged to mate with second rack 30B. In the embodiment shown, drive shaft 34 extends through respective passages 38A, 38B in first and second side members 24A, 24B of seat 22. A rotary bearing 40 may be mounted on second side member 24B of seat 22 for rotatably supporting drive shaft 34. Sides 12A and 12B are provided with respective channels 41A, 41B extending parallel to first and second racks 30A, 30B, wherein each of the channels receives a respective opposite end of drive shaft 34 to maintain pinions 36A, 36B in mated engagement with racks 30A, 30B. Attention is also directed now to FIG. 7. A control switch 42, which may be a rocker switch or other switch mechanism mounted on first side 12A in a location accessible to a user, is operable to connect a power supply 44 to motor 32 by way of leads 43 and 45 and capacitor 49 to selectively energize the motor for rotation in a desired direction. In a forward position of switch 42, drive shaft 34 and first pinion 36A will rotate in a clockwise direction as viewed in FIG. 2 to cause seat 22 to move forward such that back 18 folds out (rotates counterclockwise) relative to seat 22 toward the bed position shown in FIG. 3. In a reverse position of switch 42, drive shaft 34 and first pinion 36A will rotate in a counterclockwise direction as viewed in FIG. 3 to cause seat 22 to move backward such that back 18 folds in (rotates clockwise) relative to seat 22 toward the sofa position shown in FIG. 2.

Figure 3:
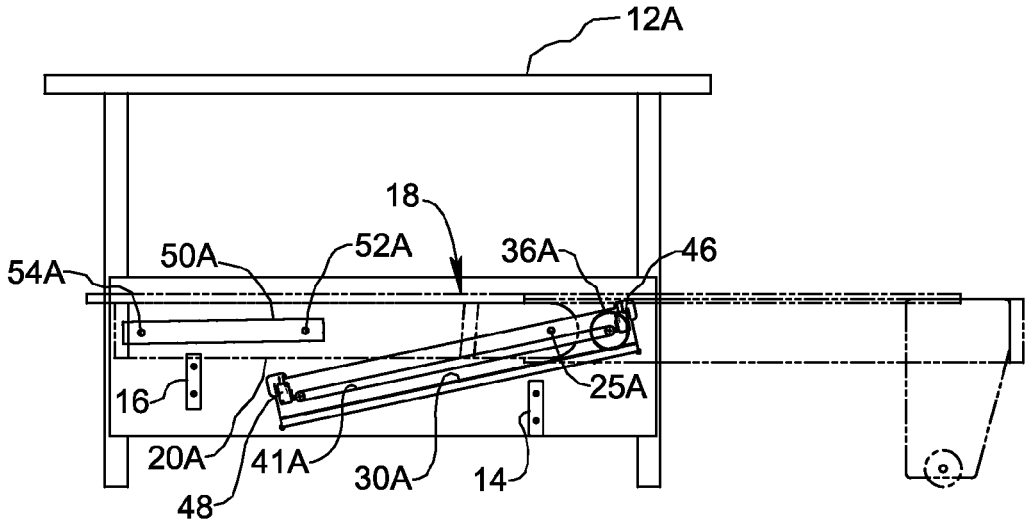
FIG. 3 is an elevational view similar to that of FIG. 2, however the back and the seat are shown in their bed position.
Figure 4:
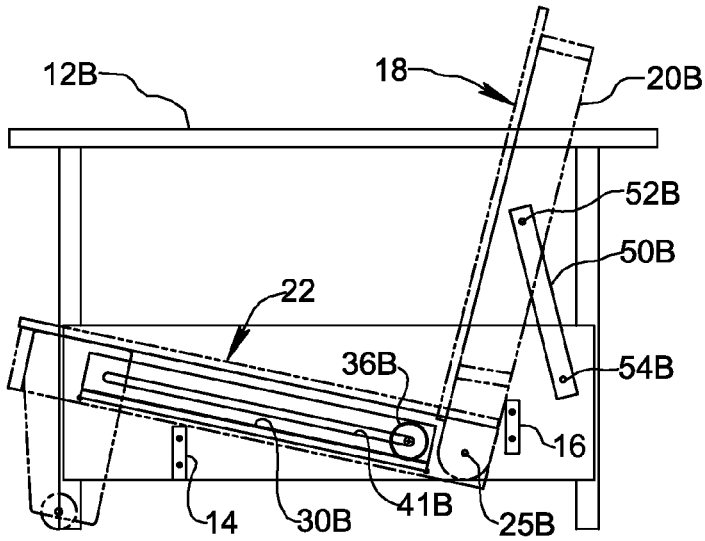
FIG. 4 is an elevational view showing the second side of the futon frame as viewed from the first side of the futon frame, wherein the back and seat of the frame are shown in phantom line in their sofa position.
Figure 5:
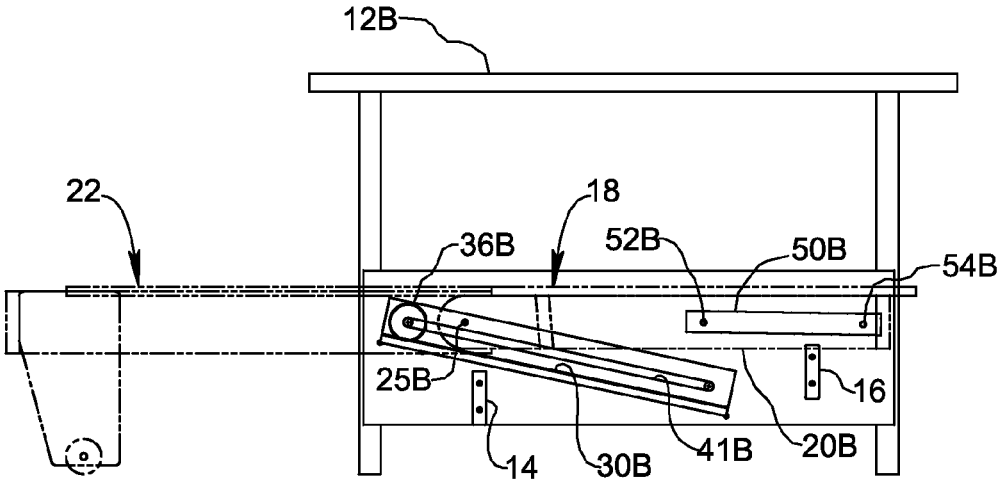
FIG. 5 is an elevational view similar to that of FIG. 4, however the back and the seat are shown in their bed position.

In an aspect of the invention, link arms 50A and 50B reside at a slight positive angle of at least 1° relative to horizontal when the frame is adjusted to the bed position as shown in FIGS. 3 and 5, with pivots 52A, 52B being slightly higher than their counterpart pivots 54A, 54B. In this way, the frame does not "lock up" when seat 22 is forced backward to begin adjustment to the sofa position.

A forward limit switch 46 and a reverse limit switch 48 may be arranged on frame side 12A near at opposite ends of first rack 30A such that each limit switch disconnects motor 32 from power source 44 upon being engaged by drive shaft 34. As may be understood from FIG. 2, when seat 22 and back 18 reach their sofa position, reverse limit switch 48 is engaged by drive shaft 34 and is thereby actuated to cut power to motor 32 and prevent further rotation in the reverse direction only. Similarly, as may be understood from FIG. 3, when seat 22 and back 18 reach their bed position, forward limit switch 46 is engaged by drive shaft 34 and is thereby actuated to cut power to motor 32 and prevent further rotation in the forward direction only. It is possible to mount control switch 42 and limit switches 46, 48 on second side 12B, however such an arrangement is not favored because it would require a more complicated wiring scheme for hard wired communication between the switches and motor 32, which is associated with first side 12A of frame 10.

In a prototype embodiment of the present invention, an alternating current PSC reversible gearmotor manufactured by Molon Motor and Coil Corporation under Part No. QAM-6005-X, having a 100:1 gear train reduction providing 6 rpm at drive shaft 34, was found to be suitable as motor 32. Power source 44 in the prototype embodiment was a standard 115V AC power source, and 10 microfarad capacitors were used for capacitors 47 and 49. In the prototype embodiment, McMaster-Carr Part No. 5174T11 was used to make racks 30A, 30B, and McMaster-Carr Part No. 5172T16 was used to make mating pinions 36A, 36B. Also in the prototype embodiment, racks 30A, 30B were inclined at an angle of 12 relative to horizontal. Rotary bearing 40 was embodied by Triangle Manufacturing Co. Part No. FLB-8 for accommodating the half-inch diameter drive shaft of the Molon motor. Wiring in the prototype was routed through grooves formed in first side 12A. While the prototype embodiment demonstrated the utility of the present invention, it is recognized that more sophisticated motor control electronics may be used to provide advanced features, for example predetermined intermediate position settings (in the manner of an automobile seat) and remote control capability.

Modifications and other embodiments of the invention described herein will be apparent to persons skilled in the art to which the invention pertains. Therefore, it is understood that the invention is not limited to any specific embodiment described herein, and that modifications and other embodiments are intended to fall within the scope of the appended patent claims.

What is claimed is:

1. An automatically adjustable futon frame comprising:

first and second opposing sides connected by front and rear support members extending laterally between the first and second sides;

a back situated between the first and second sides, the back having first and second side members respectively adjacent to the first and second sides;

a seat pivotally connected to the back for folding along a laterally extending axis, the seat having first and second side members;

first and second racks respectively fixed to the first and second sides;

a motor fixed to the seat, the motor including a drive shaft rotatable about a laterally extending drive axis;

first and second pinions mounted on the drive shaft for rotation therewith, the first pinion engaging the first rack and the second pinion engaging the second rack; and a first link arm pivotally coupled to the first side member of the back and to the first side, and a second link arm pivotally coupled to the second side member of the back and to the second side;

whereby the motor is operable to automatically adjust the back and the seat between a sofa position and a bed position.

2. The futon frame according to claim 1, wherein the motor is fixed to the first side member of the seat.

3. The futon frame according to claim 2, further comprising a control switch operable to connect a power supply to said motor, wherein the control switch is mounted on the first opposing side.

4. The futon frame according to claim 1, further comprising a pair of limit switches arranged near opposite ends of the first or second rack, wherein each of the pair of limit switches disconnects the motor from a power source upon being engaged by the drive shaft.

5. The futon frame according to claim 1, wherein each of the first and second sides includes a channel extending parallel to the first and second racks, each of the channels receiving a respective end of the drive shaft.

6. The futon frame according to claim 1, wherein the drive shaft is arranged to extend through respective passages through the first and second side members of the seat.

7. The futon frame according to claim 6, further comprising a rotary bearing mounted on the second side member of the seat for rotatably supporting the drive shaft.

8. The futon frame according to claim 1, wherein the seat includes a pair of support legs.

9. The futon frame according to claim 8, wherein each of the pair of support legs includes a wheel at a bottom end thereof for engaging a floor on which the futon frame is situated.

10. The futon frame according to claim 1, wherein the first and second link arms are each straight and extend forward at a positive angle relative to horizontal when the seat and the back are in their bed position.

11. The futon frame according to claim 1, wherein the motor is an AC gearmotor.

* * * * *